US008555966B2

(12) United States Patent
Maxit et al.

(10) Patent No.: US 8,555,966 B2
(45) Date of Patent: Oct. 15, 2013

(54) FORMATION TESTING APPARATUS AND METHODS

(75) Inventors: Jorge O. Maxit, Houston, TX (US); Jinsong Zhao, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 311 days.

(21) Appl. No.: 12/120,106

(22) Filed: May 13, 2008

(65) Prior Publication Data

US 2009/0283265 A1 Nov. 19, 2009

(51) Int. Cl.
*E21B 47/00* (2012.01)
*E21B 49/08* (2006.01)

(52) U.S. Cl.
USPC ..... 166/250.01; 166/264; 175/59; 73/152.24; 73/152.27

(58) Field of Classification Search
USPC ..... 166/264, 250.01; 175/59; 73/152.33, 73/863.01, 152.24, 152.27, 152.51
See application file for complete search history.

(56) References Cited

U.S. PATENT DOCUMENTS

| | | | | |
|---|---|---|---|---|
| 5,708,204 | A | 1/1998 | Kasap | |
| 5,959,203 | A | 9/1999 | Ajjoul | |
| 6,536,522 | B2 | 3/2003 | Birckhead et al. | |
| 6,588,266 | B2 | 7/2003 | Tubel et al. | |
| 6,622,554 | B2 | 9/2003 | Manke et al. | |
| 6,923,052 | B2 | 8/2005 | Krueger et al. | |
| 7,075,063 | B2 | 7/2006 | Dong et al. | |
| 7,117,734 | B2 * | 10/2006 | Follini et al. | 73/152.41 |
| 7,204,309 | B2 * | 4/2007 | Segura et al. | 166/264 |
| 7,243,537 | B2 | 7/2007 | Proett et al. | |
| 7,266,983 | B2 | 9/2007 | Krueger et al. | |
| 7,328,610 | B2 | 2/2008 | Manin et al. | |
| 2004/0049346 | A1 | 3/2004 | Despax et al. | |

* cited by examiner

*Primary Examiner* — Sean Andrish
(74) *Attorney, Agent, or Firm* — Cantor Colburn LLP

(57) ABSTRACT

A formation testing apparatus and method are disclosed. In one aspect, a fluid is drawn from a formation, one or more sensors measure pressure of the fluid during the during drawing of the fluid, and a processor estimates an inflection point from the pressure measurements and controls the drawing of the fluid from the inflection point until the pressure of the fluid drops to a selected level.

9 Claims, 2 Drawing Sheets

FORMATION TESTING APPARATUS AND METHODS

BACKGROUND INFORMATION

1. Field of the Disclosure

The present disclosure relates generally to formation testing apparatus and methods.

2. Description of the Related Art

Pressure-volume tests are typically performed downhole to estimate formation properties and the condition of reservoirs. To perform such tests, a downhole tool is conveyed into a wellbore. A small amount (1 cc-10 cc) of the fluid from the formation is withdrawn generally using a piston. The pressure drop at the point from which the fluid is being withdrawn starts as the drawdown starts. The total amount of the pressure drop generally depends upon the properties of the formation, such as the type of rock, permeability, etc., and the properties of the formation fluid, such as the viscosity, etc., of the fluid. In such tests, the total drop in pressure is typically not controlled and can vary substantially from one test to another and from one formation to another. After the drawdown cycle, the pressure is allowed to build-up until it reaches a stable level. The length of time it takes for the pressure to build-up to the formation pressure level (the "build-up time") depends upon the type of the formation. For example, the build-up time for tight formations can be form several minutes to hours. Typically, three draw-down and build-up tests are performed to determine the reservoir condition. Therefore, drawing preselected volumes of fluid during draw-downs can lead to excessive build-up times, especially in tight formations, which can be relatively expensive, due to idle rig and personnel time.

Therefore, there is a need for an improved apparatus and methods for formation testing applications.

SUMMARY

In one aspect, a formation testing apparatus is disclosed that may include: a device configured to draw a fluid from a formation (drawdown); a sensor configured to measure pressure of the fluid; and a processor that is configured to process signals from the sensor taken during the drawdown to estimate an inflection point in the measured pressure of the fluid and control the drawing of the fluid from the formation after the inflection point until the pressure of the fluid reaches a predetermined pressure drop.

In another aspect, a formation testing method is disclosed that may include: drawing a fluid from a formation; measuring pressure during a drawdown; estimating from the pressure an inflection point that corresponds to a mud cake break point; and drawing the fluid from the formation after the inflection point until the pressure of the fluid drops down by selected amount.

Examples of certain features of a formation testing apparatus and method are summarized rather broadly in order that the detailed description thereof that follows may be better understood. There are, of course, additional features of the apparatus and methods disclosed hereinafter that will form the subject of the claims appended hereto.

BRIEF DESCRIPTION OF THE DRAWINGS

For a detailed understanding of the disclosure herein, reference should be made to the following detailed description, taken in conjunction with the accompanying drawing in which same elements are generally referred to by same numerals and wherein.

DETAILED DESCRIPTION OF THE DRAWINGS

The disclosure herein describes a formation testing tool in reference to a specific wireline formation evaluation tool. The tool may be utilized alone in a wellbore or it may be run as a part of a wireline tool string that includes other wireline logging tools. The tool may be a part of a drill string that may include drilling assemblies and one or more measurement-while-drilling tools. Additionally, the specific instruments and methods discussed herein are not to be construed as limitations.

Figure 1:
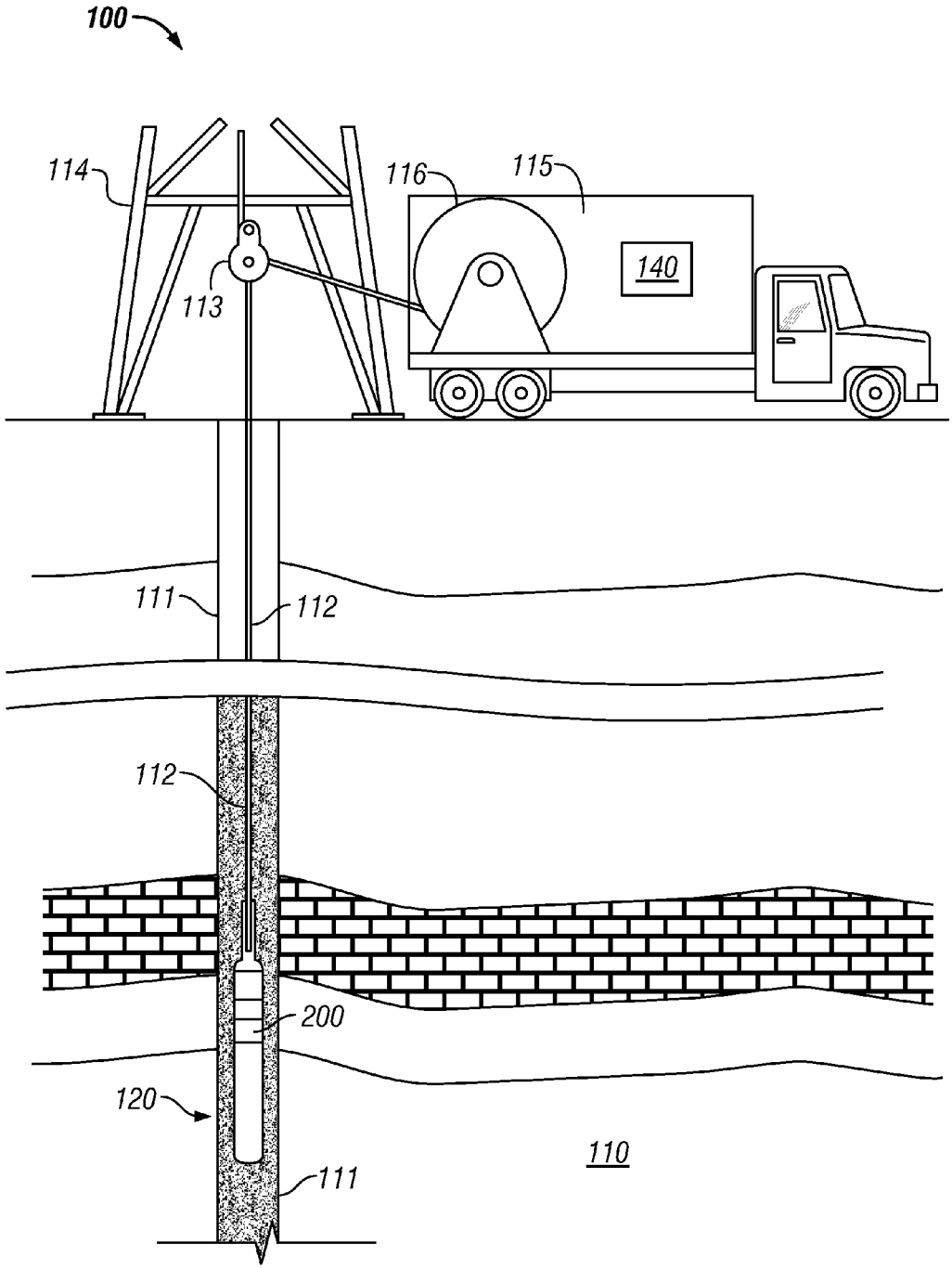
FIG. 1 is a schematic illustration of a wireline logging system that includes a downhole tool made according to one embodiment of the disclosure.

FIG. 1 is a schematic showing a wireline system 100 for performing formation testing at one or more locations in a wellbore 111 formed in an earth formation 110. The system 100 shows a tool 200, made according to one embodiment of the disclosure herein, conveyed in the wellbore 111. The tool 200 may be conveyed alone or as part of a tool string 120 by a suitable conveying member 112, such as a wireline or tubing. The tool 200 may be conveyed into the wellbore 111 from the surface by a surface rig 114 using a winch 116 placed on a surface unit 115 (such as a truck) and a pulley 113 placed on the rig 114. A tubing-conveyed system will generally include an injector (not shown) to convey the tubing and the tool 200 in the wellbore 111. Offshore systems will include a wireline unit or an injector stationed on the offshore rig. Power to the tool 200 and data communication between the tool 200 and the surface unit 115 is provided via suitable conductors in the conveying member 112. The surface unit 115 includes a control unit or controller 140, which may be a computer-based system, for controlling the operations of the tool 200. Controller 140 further may include: a processor; one or more data storage devices, such as magnetic tapes, solid state memories, etc. that store data and computer programs accessible to the processor; data input devices, such a keyboards; display devices, such as monitors; and other circuitry configured to control the operations of the tool 200 and process data received from the tool 200. To perform a formation test in the wellbore, the tool 200 is conveyed to a selected wellbore location or depth, where performing of one or more tests is desired. The tool may then be moved to other locations to perform additional tests.

Figure 2:
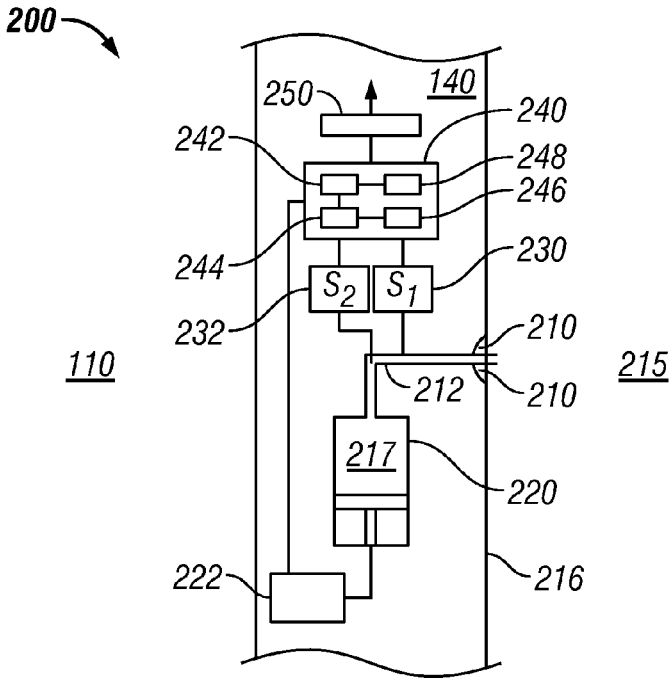
FIG. 2 is an illustration of certain details of the logging tool of FIG. 1 according to one embodiment of the disclosure.

FIG. 2 is a block diagram showing certain details of the tool 200 of FIG. 1 according to one embodiment of the disclosure. The tool 200, in one aspect, may include a device 212 to receive fluid from the formation, such as a probe, enclosed in a sealing element 210, such as a pad configured to seal against the wellbore wall 216. In one aspect, the sealing element 210 may be placed on a suitable extensible member that is configured to press the sealing element 210 against the wellbore wall 216 to seal an area around the probe member. Pressing the sealing element also causes the probe to penetrate the formation 110. A fluid suction device 220, such as a piston or pump, coupled to the sealing element 212 may be used to extract fluid 215 from the formation 110. The fluid suction device 220 may be operated by a suitable prime mover or device 222, such as, but not limited to, an electrical motor or hydraulic motor. The tool 200, in one aspect, may further include a first sensor 230 ($S_1$), which may be a fast response pressure sensor, such as a strain gauge. Strain gauges typically have response times of about 10 milliseconds and an accuracy of about 1.0 psi or lower. The tool 200 also may include a second sensor 232 ($S_2$), which may be a relatively high accuracy pressure sensor, such as such as a quartz pressure sensor. Quartz pressure sensors typically have an accuracy of about 0.01 psi and a relatively slow response time of about 1.0 second or greater. The tool 200 further may include a controller 240 that may further include a processor 242, a storage device 244, such as a solid-state memory, configured to store data and computer programs 246 accessible to the processor 242, and other circuitry 248 for controlling downhole operations of the tool and for partially or fully processing measurements made by the sensors. In another aspect, the data may be processed uphole by the surface controller 140 or it may be processed partially by the downhole processor 242 and partially by the surface controller 140. A suitable telemetry unit 250, including but not limited to an electrical or fiber optic system, may be used to communicate data between the surface controller 140 and the downhole controller 240. The operation of the tool 200 downhole is described below in reference to FIGS. 2 and 3.

Figure 3:
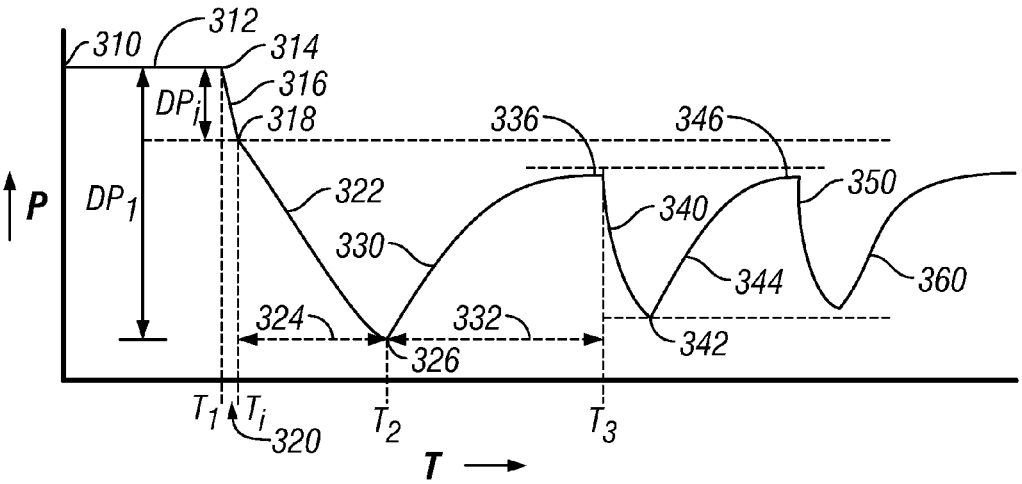
FIG. 3 is an exemplary graph of pressure versus time that may result from a formation test performed by the tool of FIGS. 1 and 2 in a wellbore.

FIG. 3 is an exemplary graph 300 of pressure ("P") of the fluid versus time ("T") that may result from a pressure test performed by a tool, such as tool 200. The pressure P is shown along the vertical axis while time T is shown along the horizontal axis. Referring to FIGS. 2 and 3, once the tool 200 has been set at the desired location or depth in the wellbore 111, sealing element 210 is set against the wellbore wall 216 so that the probe member 212 penetrates the wellbore wall 216. Both sensors 230 and 232 measure the pressure 310 at the formation. This pressure corresponds to the hydrostatic pressure exerted on the formation by the weight of the mud column in the wellbore. The sensors 230 and 232 are typically allowed to continue to measure the pressure for a certain time period $T_1$ to ensure the pressure has stabilized, as shown by constant line 312. The high resolution sensor 232 is typically used to confirm pressure stabilization.

Once the pressure at 310 has stabilized, the strain gauge sensor 230 may be calibrated by using pressure measurements made by the strain gauge sensor 230 and the quartz sensor 232. At time $T_1$, that corresponds to the stable pressure 314, the controller 240 or 140 or a combination thereof activates the prime mover 222 to move the piston 220 to extract the fluid 217 from the formation 110 into the piston 220. The piston volume may be any amount but is generally relatively small, such as between 1 cc to 10 cc. The drawing of the fluid from the formation is referred to herein as the "drawdown" and the first such drawing is referred to herein as the "first drawdown." The pressure of the drawn fluid starts to drop from the original pressure 314 relatively rapidly, as shown by the declining line 316.

A layer of mud (also known in the art as "mud cake") is typically present along the wellbore wall 216. The mud cake is formed by the invasion of the drilling fluid into the formation during drilling of the wellbore because the hydrostatic pressure exerted by the mud column at any given depth is greater than the innate formation pressure at that depth. The mud cake also tends to form a seal along the wellbore wall. After a certain amount of time during the first drawdown, the mud cake tends to break, as indicated by point 318, at which point the rate (dp/dt) of the pressure drop changes. The pressure at which the rate of the pressure drop changes during the first drawdown is referred to herein as the "inflection point" or "mud cake break point." As noted above, the sensor 230, such as a strain gauge, has a relatively fast response time (a few milliseconds). Such a sensor is capable of providing sufficient number of pressure measurements (pressure data points) during the time $T_i$-$T_1$ to estimate the inflection point. The more accurate sensor 232, such as a quartz sensor, typically has a relatively slow response time (about 1.0 sec) and may not provide sufficient measurement data points from which the inflection point may be determined. Although a strain gauge is used herein as an example of a fast response pressure sensor, any suitable sensor that provides sufficient measurements during the time Ti-T1 may be used for estimating the inflection point. Also, it is noted that a quartz sensor is used herein as an example of a high resolution sensor. Any suitable sensor may be used for the purposes of the disclosure. Furthermore, both the fast response sensor 230 and the relatively more accurate sensor 232 may be used to continuously or substantially continuously obtain pressure measurements. The controllers 240 and/or 140 or a combination thereof may utilize programmed instructions to estimate the inflection point from pressure measurements made during the first drawdown. The portion shown by line 316, which corresponds to the time Ti-T1, is sometimes referred herein as the first segment 320 of the first drawdown. In one method, the inflection point 318 may be estimated from the first derivative (dp/dt) or second derivative ($d^2p/dt^2$) of the pressure-over-time relationship during the first drawdown.

The controllers 140 and/or 240 then may control the operation of the device 220 to controllably draw the fluid further from the formation 110 for a second segment 324 ($T_2$-$T_i$) until the pressure of the fluid along line 322 drops down by a desired amount ($DP_1$-$DP_i$), as shown by level 326. The drop in pressure from the initial pressure 314 and the inflection point 318 is shown by $DP_i$ and the total drop in the pressure during the first drawdown is shown by $DP_1$. In one aspect, the pressure 326 may by chosen to reduce or minimize the time it will take for the pressure to build-up and approach a stable level during an ensuing pressure build-up cycle, as described in more detail below. At the end of the first drawdown, i.e., at or around time $T_2$, the pressure starts to rise, as shown by curve 330 and it approaches a stable level, such as shown by the pressure curve 336. The stable pressure value may be determined from a curve fitted to the measured pressures. The measured pressure may be said to be approaching the stable level when the difference between the measured pressure and the stable level is less than or equal to a selected amount or when the difference in successive pressure measurements is less than or equal to a selected amount. Any other criterion may be used for the purpose of this disclosure. The pressure build-up curve 330 represents the first "build-up." The sensors 230 and 232 measure the pressure along the first build-up time 332. The first sensor 230 may again be calibrated by using the measurements made at the along the curve 336 (also referred to as the first stable build-up pressure) by the first sensor and the second sensor 232.

Once it is determined that the pressure has approached a stable pressure, the controllers 140 and/or 240 may initiate a second drawdown as shown by curve 340 and continue to control the drawdown process until the pressure drops to a second selected or predetermined pressure 342. The controllers 140 and/or 240 then may allow the pressure to build up (second build-up) 344 so that the pressure approaches a second stable pressure 346. Both the sensors 230 and 232 may be used to measure the pressure during the second drawdown and second build-up cycle. Additional drawdown and build-up cycles, such as a third drawdown 350 and a third build-up 360, may be obtained using the method described above. Generally, a total of three drawdown and build-up cycles are adequate to estimate the formation properties. In one aspect, a processor may be configured to estimate a property of the formation using data from one or more drawdown and build-up cycles. The data used may include pressure, drawdown volume, and build-up time and the property of the formation may be permeability, porosity, etc. The processor may also be configured to estimate other formation characteristics, such as formation type, etc. Estimating the inflection point and controlling the pressure drop thereafter during the first drawdown may allow the system 100 to reduce and in some cases minimize the build-up time for the first and subsequent build-up times. Knowledge of the pressure drop at the end of the first drawdown also may aid in selecting the second drawdown pressure and so forth. In a tight formation, the build-up time for each cycle using the conventional methods can be relatively long, such as from few minutes to more than an hour. Estimating the inflection point and then controlling the pressure drop during drawdown can aid in reducing the pressure drop during each drawdown and thus reduce the corresponding build-up time. The pressure drop during any drawdown may be controlled by controlling the fluid pressure drop, drawdown volume, drawdown time or any combination thereof.

The apparatus and methods described above use specific embodiments. This is not to be construed as a limitation of the embodiments that may be utilized for estimating an inflection point or controlling the drawdown and build-up cycles for the formation evaluation apparatus or the methods described herein. Additionally, the embodiments described herein reference wireline tools. The apparatus and methods described herein, however, are equally applicable for use with tools conveyed on a tubular, such as coiled tubing or slickline, and with a drill string used for drilling wellbores. Further, implicit in the processing of measurements and other data herein is the use of a computer programs stored on a suitable machine-readable medium that enables a processor to perform the controls and data processing relating to the apparatus and methods described herein. The computer programs include instructions to perform the various control functions and the features of the methods described herein. The machine-readable medium may include any suitable medium, including but not limited to ROMs, EPROMs, EAROMs, Flash Memories and Optical disks. The measurements, data and estimated parameters may be stored in any suitable media.

Thus, in view of the above description, a formation testing method according to one aspect, may include: drawing a fluid from a formation ("the first drawdown"); measuring pressure during a portion of the first drawdown using a first sensor; estimating from the measured pressure an inflection point that corresponds to a mud cake break point; and controllably drawing the fluid after the inflection point during the first drawdown. The fluid may be withdrawn until the fluid pressure drops to a selected pressure level or by controlling the drawdown volume or by drawing the fluid for a selected time period or any combination thereof. The inflection point may be estimated by using any suitable technique, including, but not limited to, using a first derivative of the measured pressure versus time or a second derivative of the measured pressure versus time. In another aspect, the method may further include allowing the pressure of the fluid to build up to approach a first stable level and measuring pressure of the fluid thereafter using a second sensor. Further, the first sensor, in one aspect, may be a strain gauge and the second sensor a quartz gauge. The method may also include calibrating in-situ the first sensor using measurements made by the first and second sensors at least two points each. The method may further include drawing the fluid from the formation after the pressure has built up to a selected level ("the second drawdown") until the pressure drops down to a second selected level, allowing the pressure of the fluid to build up to a second level; and measuring the pressure approaching the second level using the second sensor. The method also may include estimating a property of the formation using one or more of a: drawdown volume; drawdown pressure; and build-up time. The estimated property of the formation may be one of permeability and porosity.

In another aspect, a formation testing apparatus is provided that in one embodiment may include: a device configured to draw fluid from a formation during a first drawdown; a first sensor configured to measure a pressure of the fluid; and a processor configured to process signals from the first sensor taken during the first drawdown to estimate an inflection point in the measured pressure of the fluid and control the drawing of the fluid from the formation after the inflection point until the pressure of the fluid drops by a first selected amount or reaches a selected level. The processor may be further configured to allow the pressure of the fluid to build up to approach a first stable level. The processor may estimate the inflection point from a first derivative of the measured pressure versus time, a second derivative of the measured pressure versus time or both. The apparatus may further include a second sensor configured to take pressure measurements upon pressure approaching the first stable level. The first sensor may be a fast response pressure sensor, such as a strain gauge sensor, and the second sensor may be high accuracy pressure sensor, such as a quartz pressure sensor. The processor may calibrate in-situ the first sensor using measurements made by the first and second sensors before a drawdown and/or after a build-up. The processor may also be configured to estimate a property of the formation using one or more of: a draw down volume; a drawdown pressure; and a build-up time. The estimated property may include one or more of: permeability of the formation; porosity of the formation; and reservoir characteristics. The apparatus may further include a probe configured to contact the formation; and a piston associated with the probe configured to withdraw the fluid from the formation, wherein at least one sensor is in pressure communication with the withdrawn fluid for taking pressure measurements.

In another aspect, a system is provided that may include: a conveying member configured to convey a formation testing tool into the wellbore; the formation testing tool may include: a device for withdrawing fluid from the formation; a first sensor and a second sensor configured to take pressure measurements of the drawn formation fluid; and a processor configured to estimate an inflection point in the pressure measured by the first sensor during a first drawdown of the formation fluid, control the drawing of the formation fluid from the formation after the inflection point until the pressure of the fluid has dropped to a first selected level, and to monitor the formation fluid pressure to build-up.

The foregoing description is directed to particular embodiments for the purpose of illustration and explanation. It will be apparent, however, to one skilled in the art that many modifications and changes to the embodiments set forth above are feasible without departing from the scope and spirit of the embodiments and concepts disclosed herein. It is intended that the following claims be interpreted to embrace all such modifications and changes.

What is claimed is:

1. A formation testing method, comprising:

calibrating a fast response sensor to a slow response sensor;

drawing a fluid from a formation during a first drawdown of a formation test;

determining drawdown pressure during the first drawdown before an inflection point of the drawdown pressure using measurements from the fast response sensor without measurements from the slow response sensor;

estimating the inflection point of the drawdown pressure using the drawdown pressure determined using the measurements from the fast response sensor without the measurements from the slow response sensor;

controllably drawing the fluid after the inflection point; and determining the drawdown pressure during the controlled drawing of the fluid after the inflection point using measurements from the slow response sensor to test the formation.

2. The method of claim 1, wherein controllably drawing the fluid comprises drawing the fluid as one or more of: until the pressure drops to a selected level; for a selected time period; and for a selected volume.

3. The method of claim 1 further comprising estimating the inflection point by using one of: (i) a first derivative of the measured pressure versus time; (ii) a second derivative of the measured pressure versus time: (iii) first and second derivatives of the measured pressure versus time.

4. The method of claim 1 further comprising:

allowing the pressure of the fluid to build up to approach a first stable level ("first build-up"); and measuring the pressure of the fluid using the slow response sensor at the first build-up.

5. The method of claim 4, wherein the fast response sensor is a strain gauge and the slow response sensor is a quartz gauge.

6. The method of claim 4 further comprising calibrating in-situ the fast response sensor using measurements made by the fast response and slow response sensors.

7. The method of claim 4 further comprising:

drawing the fluid from the formation after the first build-up ("the second drawdown") until the pressure of the fluid drops to a second selected level;

allowing the pressure of the fluid to build up to approach a second stable level; and measuring the pressure using the slow response sensor.

8. The method of claim 2 further comprising estimating a property of interest using one or more of: a drawdown volume; a drawdown pressure; a build-up time; and a pressure drop.

9. The method of claim 8, wherein the property of interest is one or more of: (i) permeability; (ii) porosity; (iii) fluid compressibility; and (iv) viscosity.

* * * * *